United States Patent [19]

Kawaguchi et al.

[11] Patent Number: 4,603,729

[45] Date of Patent: Aug. 5, 1986

[54] PIPING ASSEMBLY FOR USE IN ROLL SECTION OF CONTINUOUS CASTING LINE

[75] Inventors: Hiroshi Kawaguchi; Hirofumi Sasaki; Mamoru Nishida; Shinichi Harada, all of Kobe, Japan

[73] Assignee: Kabushiki Kaisha Kobe Seiko Sho, Kobe, Japan

[21] Appl. No.: 603,898

[22] Filed: Apr. 25, 1984

[30] Foreign Application Priority Data

Jun. 17, 1983 [JP] Japan ..... 58-93443[U]
Jun. 17, 1983 [JP] Japan ..... 58-93444[U]

[51] Int. Cl.[4] ..... B22D 11/12
[52] U.S. Cl. ..... 164/442; 164/448
[58] Field of Search ..... 164/448, 442, 443, 444, 164/486

[56] References Cited

U.S. PATENT DOCUMENTS 3,572,423 3/1971 Kick et al. ..... 164/442
3,651,857 3/1972 Koch ..... 164/448
3,727,673 4/1973 Gallucci ..... 164/442
4,071,073 1/1978 Bollig et al. ..... 164/448
4,137,963 2/1979 Langer et al. ..... 164/448

FOREIGN PATENT DOCUMENTS 2454902 6/1976 Fed. Rep. of Germany ..... 164/448
2637179 3/1977 Fed. Rep. of Germany ..... 164/448

*Primary Examiner*—Francis S. Husar
*Assistant Examiner*—Jerry Kearns
*Attorney, Agent, or Firm*—Oblon, Fisher, Spivak, McClelland & Maier

[57] ABSTRACT

A piping assembly suitable for cooling a roller section in a secondary cooling zone of a continuous casting line, the roller section having a number of cast strip guide rollers mounted on a support frame through bearing boxes, wherein the piping system includes cooling water passages provided within the frame of the roller section and cooling water circulating ports formed in the wall of the frame and disconnectibly connected to cooling water passages in the bearing boxes and guide rollers.

8 Claims, 17 Drawing Figures

PIPING ASSEMBLY FOR USE IN ROLL SECTION OF CONTINUOUS CASTING LINE

BACKGROUND OF THE INVENTION

1. Field of the Invention

This invention relates to a piping assembly particularly suitable for circulation of cooling water in a secondary cooling zone of a continuous casting line.

2. Description of the Prior Art

For cooling cast strip (in this specification, the term "strip" is intended to mean a slab, broom and billet) guide rollers and their bearing boxes in a secondary cooling zone of a continuous casting line, it has been the conventional practice to provide a number of water feed and discharge pipes along a roll section for connection to the respective rollers and bearing boxes. As a result, there must be provided a very complicated piping assembly which is difficult to assemble such that the piping work becomes almost impossible, particularly in a case where the guide rollers are mounted close to each other in a limited space. Due to the difficulty of providing rigid piping, it is often necessary to use flexible tubes in various parts of a piping system, which however are unreliable with respect to durability and are accompanied by the possibility of water leaks occurring at joint portions. In addition, since complicated pipings are exposed, the restoring effort required after a breakout of a cast strip is very difficult and troublesome, lowering the operational efficiency of the casting facilities to a considerable degree.

SUMMARY OF THE INVENTION

It is therefore an object of the present invention to provide a piping assembly suitable for use in a secondary cooling zone of a continuous casting line, which can eliminate the above-mentioned difficulties and problems.

It is a more particular object of the present invention to provide a piping assembly of the sort mentioned above, which utilizes a frame of a roll section in a secondary cooling zone of a continuous casting line as passages for a coolant or cooling water to be circulated to and from the respective rolls and their bearing boxes.

It is another object of the present invention to provide a piping assembly of the sort mentioned above, which employs on frames of a roll section a number of manifold blocks containing passages for conveying cooling water to and from the respective rollers and their bearing boxes.

According to the present invention, there is provided a piping assembly suitable for use in a roller section in a secondary cooling zone of a continuous casting line, the roller section having a number of cast strip guide rolls mounted on a frame through bearing boxes, characterized in that the piping system comprises a plurality of cooling water passages provided in the frame of the roller section and having circulating ports detachably connectible to cooling water passages of the respective rollers and bearing boxes.

In one particular form of the invention, a frame of a roller section which supports a number of cast strip guide rolls is internally divided into a feed water header and a discharge water header having circulating ports which are disconnectibly connected in a liquid tight manner to cooling water passages in bearing boxes at opposite ends of each roll, and the cooling water passages in the bearing boxes are disconnectibly connected to a cooling water passage in the roll to circulate cooling water from the feed water header to the discharge water header through a bearing box at one end of each roller, the roller itself and a bearing box at the other end of the roller.

The above and other objects, features and advantages of the present invention will become apparent from the following description and appended claims, taken in conjunction with the accompanying drawings which show by way of example some illustrative embodiments of the invention.

DETAILED DESCRIPTION OF THE PREFERRED EMBODIMENTS

Figure 1:
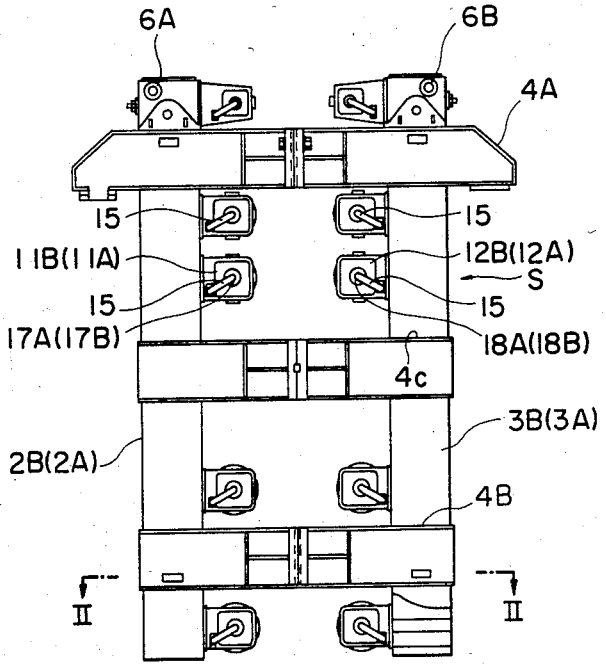
FIG. 1 is a schematic front view of a roll section incorporating a piping assembly according to the invention.
Figure 2:
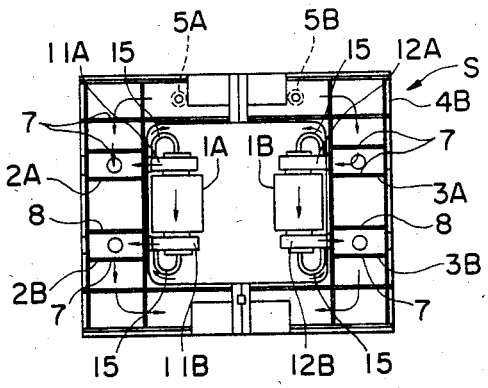
FIG. 2 is a schematic sectional view taken on line II—II of FIG. 1.

Referring to the drawings and first to FIGS. 1 and 2, there is shown a roller section S of a continuous billet casting line, having a plurality of paired rollers 1A and 1B in vertical rows for contacting with opposite lateral sides of a cast strip, in a secondary cooling zone between a mold (not shown) and pinch rolls (not shown).

The roller section S is provided at one side thereof with a pair of vertical frame members 2A and 2B and provided at the other side thereof with a pair of similar vertical frame members 3A and 3B. These four vertical frame members 2A, 2B, 3A and 3B are connected to rectangular horizontal frame members 4A, 4B and 4C at respective upper, lower and intermediate portions to constitute a frame of the roller section S.

The vertical frame members 2A, 2B, 3A and 3B and the horizontal frame members 4A to 4C are each in the form of a square tube. The lower horizontal frame member 4B is provided with water inlets 5A and 5B, while the vertical frame members 2B and 3B are provided with water outlets 6A and 6B at the upper ends thereof. Further, cooling water circulating holes or ports 7 are formed in the walls on opposite sides of the vertical frame members 2A and 3A, at positions which are connected to the horizontal frame members 4A to 4C, as well as in the walls on one side of the vertical frame members 2B and 3B. On the other hand, the vertical frame members 2B and 3B are provided with partition walls 8 on their inner sides opposing the vertical frame members 2A and 3A, respectively, so that the vertical frame members 2A and 3A constitute a feed water header and the vertical frame members 2B and 3B a discharge water header, circulating cooling water through the respective horizontal frame members 4A to 4C.

The vertical frame members 2A, 2B, 3A and 3B are provided with bearing box mounting holes 9 at predetermined intervals on the respective inner sides which face each other, and have a mounting seat 21 with a sealing or packing member 10 securely fixed on the outer frame surface around each bearing box mounting hole 9.

Figure 3:
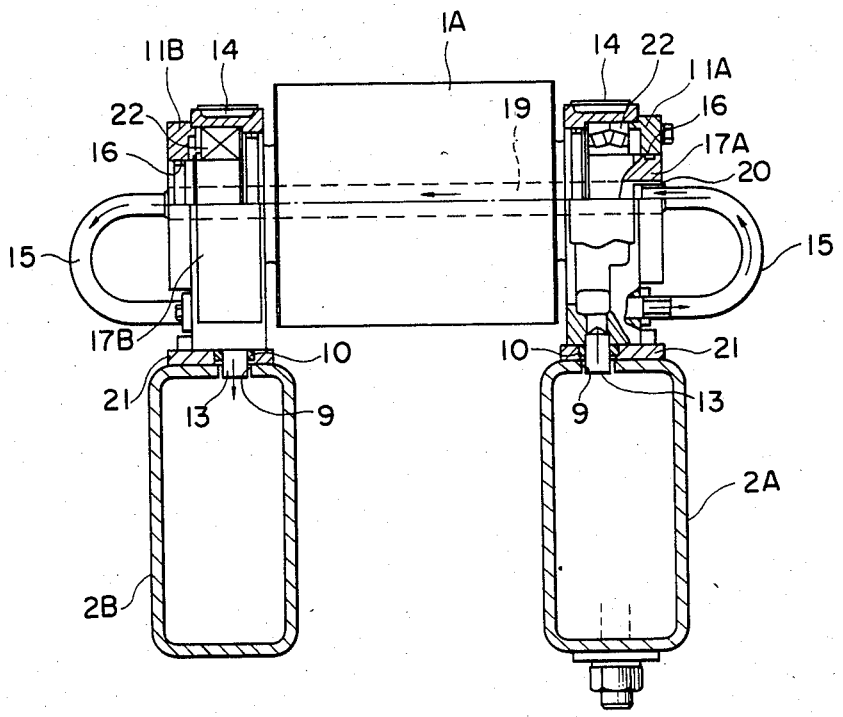
FIG. 3 is a schematic sectional view showing major components of the piping assembly on an enlarged scale.
Figure 4:
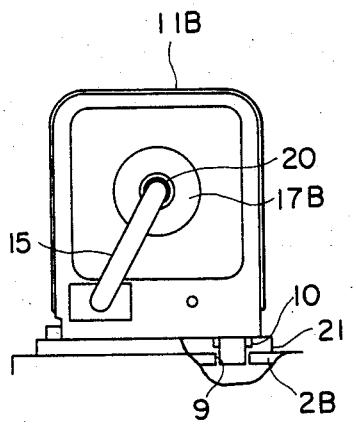
FIG. 4 is a left side view of the bearing box of FIG. 3.
Figure 5:
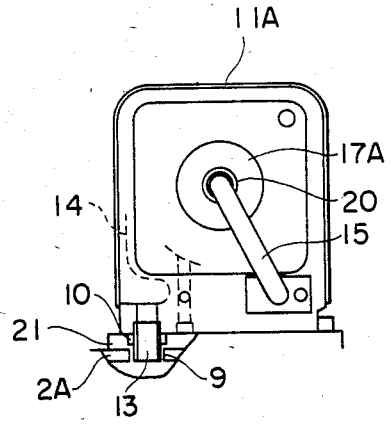
FIG. 5 is a right side view of the bearing box of FIG. 3.

As shown particularly in FIGS. 3 and 4, the bearing boxes 11A, 11B, 12A and 12B which are coupled with the opposite ends of the rollers 1A and 1B are rectangular in shape and are each provided with a joint pipe 13 which is projected from the lower wall and fitted in the mounting hole 9 in such a manner that it is lip-sealed by the packing member 10 upon insertion in the mounting hole 9. The bearing boxes 11A to 12B are each provided with a cooling water jacket or passage 14 which is in communication with the inner end of the joint pipe 13 and extend along the circumference of the box. One end of a U-shaped circulating pipe 15 is secured to the outer wall of each bearing box in communication with the other end at the bottom wall portion of the cooling water passage 14. The other end of the circulating pipe 15 is centrally positioned in a shaft hole 16 formed at the center of the outer wall of the bearing box, and fitted in a cooling water passage 19 opening at the center of a corresponding roller shaft end 17A, 17B, 18A or 18B of the roller 1A or 1B which is in turn fitted in the shaft hole 16, disconnectibly conneeting the circulating pipe 15 with a lip seal by a packing member which is provided on the inner periphery of the passage 19. The rollers 1A and 1B are each formed with axial cooling water passage 19 passing axially through the respective shaft from one to the other end thereof, so that cooling water from one circulating pipe 15 at one end will flow into the circulating pipe 15 at the other end through axial passage 19. The bearing boxes 11A to 12B are each provided with a bearing 22 on the inner periphery of the shaft hole 16 for rotatably supporting opposite ends of the roller shaft.

With the cooling system of the above-described construction, cooling water which is fed to the lower horizontal frame member 4B through water inlets 5A and 5B flows through cooling water circulating holes 7 into the vertical frame members 2A and 3A which serve as a feed water header. As shown in FIG. 3, the cooling water in the vertical frame members 2A and 3A flows into bearing boxes 11A and 12A through the joint pipes 13 and, after circulation through the cooling water passage 14 extending along the circumference of the bearing boxes 11A and 12A, enters the cooling water pipes 15 and the cooling water passages 19 from one shaft ends 17A and 18A of the rollers 1A and 1B. The cooling water which has run through the cooling water passages 19 of the rollers 1A and 1B flows out at the other shaft ends 17B and 18B into the circulating pipes 15 attached to the bearing boxes 11B and 12B, and, after circulation through the water jackets 14 around the bearing boxes 11B and 12B, goes through pipes 13 into the vertical frame members 2B and 3B which serve as a discharge water header. The cooling water which has entered the vertical frame members 2B and 3B flow into the other side of the horizontal frame member 4B, thus circulating the cooling water through the entire body of the frame member 4B. After repeating the cooling water circulation for the respective rollers 1A and 1B in this manner, the cooling water is discharged through water discharge ports 6A and 6B at the upper ends of the vertical frame members 2B and 3B, respectively.

As is clear from the foregoing description, the cooling water is circulated to every part of the frame members 2A, 2B, 3A, 3B and 4A to 4C for cooling the frame as a whole, and at the same time cooling the bearing boxes and rollers by circulation through the circumferential water jackets of the respective bearing boxes and the axial cooling water passages in the shaft portions of the rollers 1A and 1B.

In addition, since the water passages to and from the bearing boxes 11A to 12B are connectible in a lip-sealed state to the vertical frame members 2A to 3B simply by detachably fitting the pipes 13, and similarly the water passages to and from the shaft portions of the rollers 1A and 1B can be connected in a lip-sealed state to permit rotation of the rollers simply by detachably fitting the opposite roller shaft ends in the bearing boxes 11A to 12B, the piping work can be performed in an extremely facilitated manner.

Figure 7:
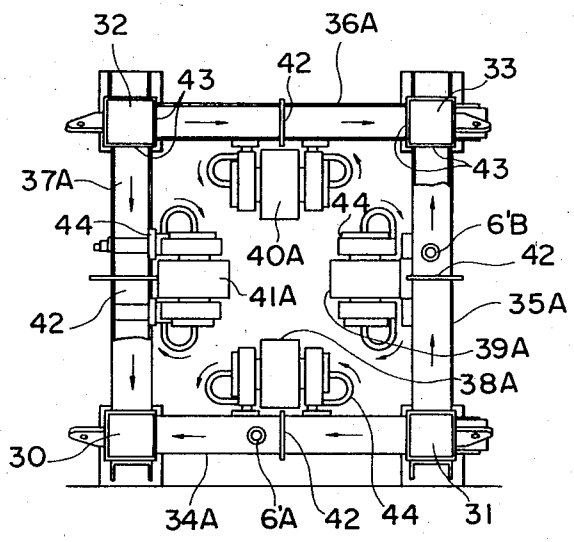
FIG. 7 is a schematic plan view of the piping assembly of FIG. 6.
Figure 6:
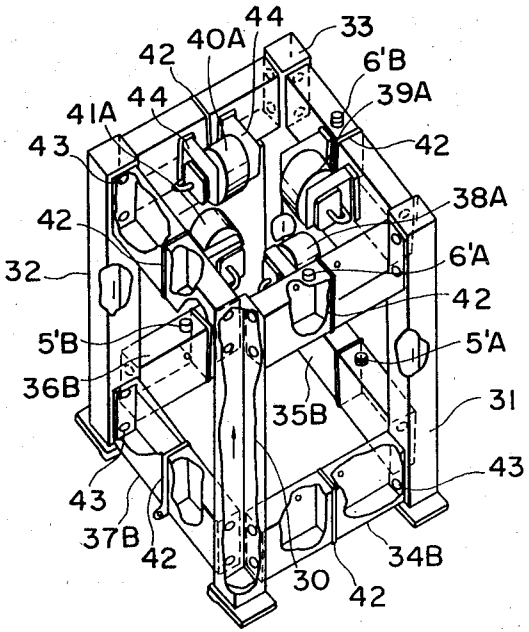
FIG. 6 is a schematic perspective view of a modification of the embodiment shown in FIGS. 1 to 5.
Figure 8:
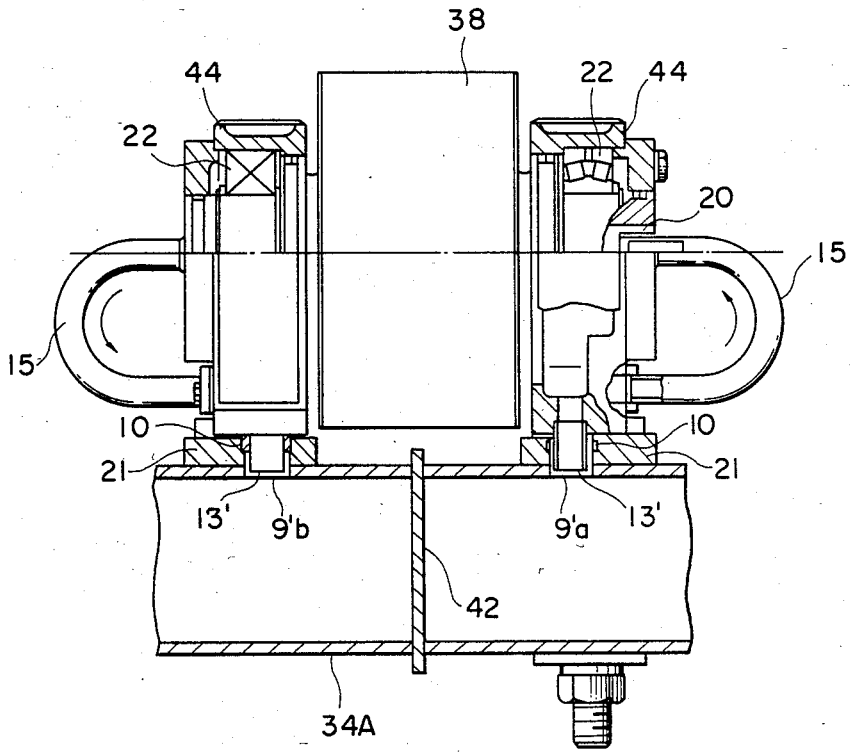
FIG. 8 is a schematic sectional view showing major components of the piping assembly of FIG. 7 on an enlarged scale.

FIGS. 6 to 8 illustrate another embodiment of the invention, applying the above-described principles to a roller section which is arranged to guide the four sides of a cast strip. More particularly, in this case a roller section is constituted by four vertical frame members 30 to 33 the upper and lower ends of which are connected in a rectangular shape by horizontal frame members 34A to 37A and 34B to 37B, detachably mounting rollers 38A(B) to 41A(B) opposingly on horizontal frame members 34A to 37A (rollers 38B to 41B on the lower horizontal frame members are omitted for the sake of simplicity of illustration). Bearing box mounting holes 9'*a* and 9'*b* are bored at a suitable interval on the inner side of each one of the horizontal frame members 34A to 37B. These horizontal frame members 34A to 37B are internally provided with a partition plate 42 at a median position between the bearing box mounting holes 9'*a* and 9'*b*. The lower horizontal frame members 35B and 36B are provided with water inlet ports 5'A and 5'A, and the upper frame members 34A and 35A are provided with water discharge ports 6'A and 6'B. A cooling water circulating hole 43 is provided at the joints of the vertical frame members 30 to 33 and the horizontal frame members 34A to 37B, so that the vertical frame members 30 and 33 constitute a discharge water header and the vertical frame members 31 and 32 a feed water header, circulating the cooling water through the horizontal frame members 34A to 37B. Detachably coupled with the opposite ends of the rollers 38A(B) to 41A(B) are bearing boxes 44 which are each provided with an outwardly projected joint pipe 13' to be extractably inserted in the aforementioned mounting hole 9'*a* or 9'*b*. The bearing boxes 44 and the rollers 38A(B) to 41A(B) have the same construction as the bearings boxes 11A to 12B and rollers 1A and 1B of the preceding embodiment, so that their component parts are designated by like reference numerals and their description in this respect is omitted to avoid repetition.

In the embodiment of FIGS. 6 to 8, the cooling water which enters the frame through the water inlets 5'A and 5'B flows through feed water header 31 and 32 into the horizontal frame members 34A to 37B on one side of the respective partition plates 42 and then into the other sides of the frame members 34A to 37B through the mounting holes 9'*a* leading to bearing boxes on the upstream side, the rollers 38A(B) to 41A(B) and the bearing boxes 44 on the downstream side, and flows out through water outlets 6'A and 6'B through the discharge water header frames 30 and 33.

Figure 9:
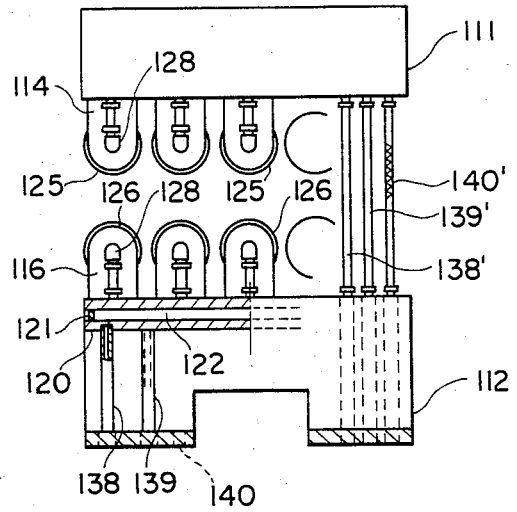
FIG. 9 is a partial sectional view of another embodiment of the invention, employing a number of manifold blocks.
Figure 10:
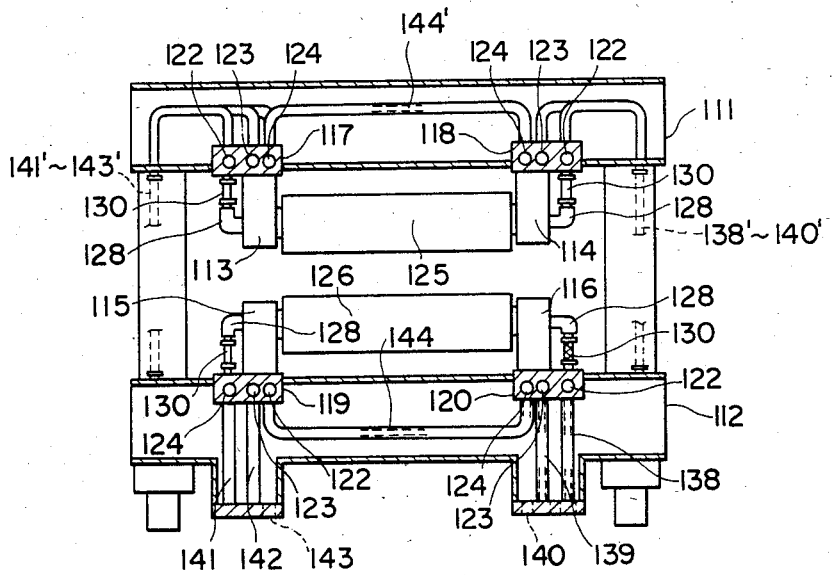
FIG. 10 is a sectional front view of the piping assembly of FIG. 9.

Referring now to FIGS. 9 to 12, there is shown a further embodiment of the invention, providing in the frame of the roller section a number of manifold sections each containing at least a bearing box cooling water passage and a roll cooling water passage. More specifically, as seen in FIGS. 9 and 10, upper and lower frames 111 and 112 of the roller section are each provided with a pair of laterally extending manifold blocks 117 and 118 or manifold blocks 119 and 120 which are securely welded in positions for mounting a pair of bearing boxes 113 and 114 or bearing boxes 115 and 116.

Each one of the manifold blocks 117 to 120 is provided with an array of three bored holes in the axial direction of the roll, and plug members 121 are fitted in the opposite open ends of the bored holes which can serve as, for example, a roll cooling water passage 122, a bearing box cooling water passage 123 and a bearing box communicating passage 124. The manifold blocks 117 to 120 are each formed with passages 122 to 124 before mounting on the upper and lower frame members 111 and 112. The bearing boxes 113 to 116 which supports the upper or lower rolls 125 and 126 are mounted on the respective manifold blocks 117 to 120.

Figure 11:
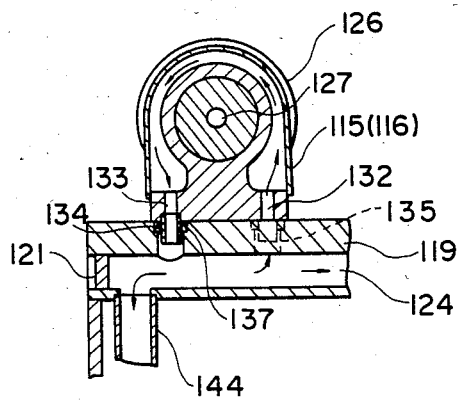
FIG. 11 is a sectional side view of a bearing box and a manifold block.
Figure 12:
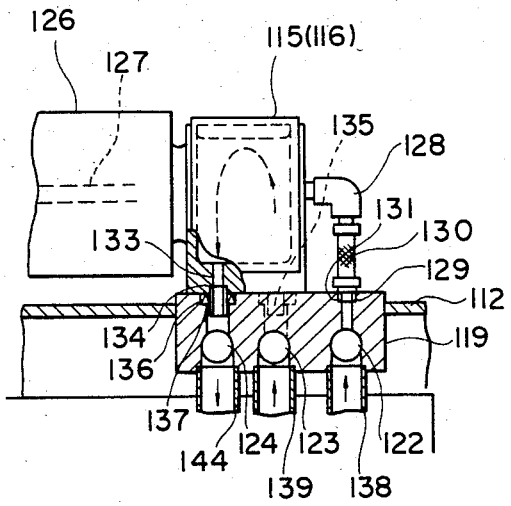
FIG. 12 is a partial sectional front view of the bearing box and manifold block shown in FIG. 11.
Figure 13:
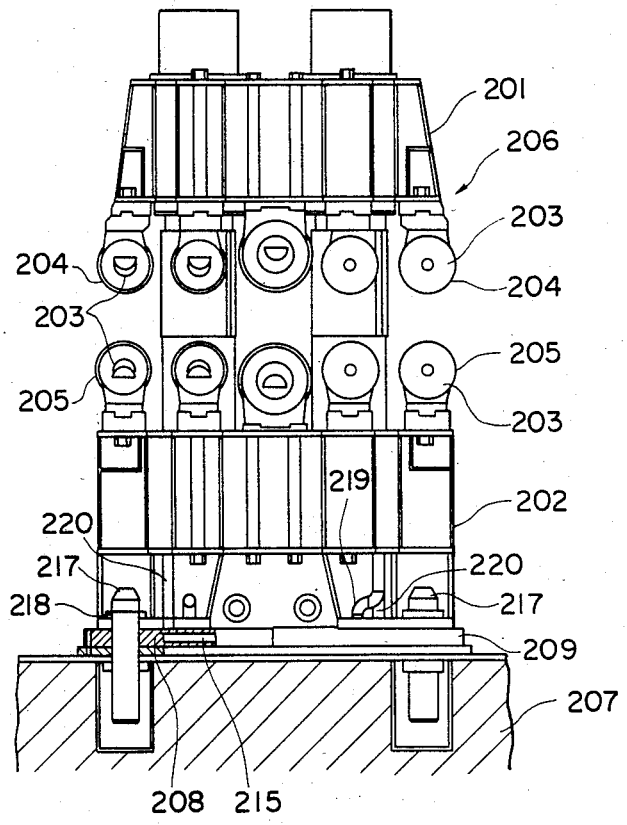
FIG. 13 is a schematic side view of a roll section incorporating in its base frame a piping assembly according to the present invention.
Figure 14:
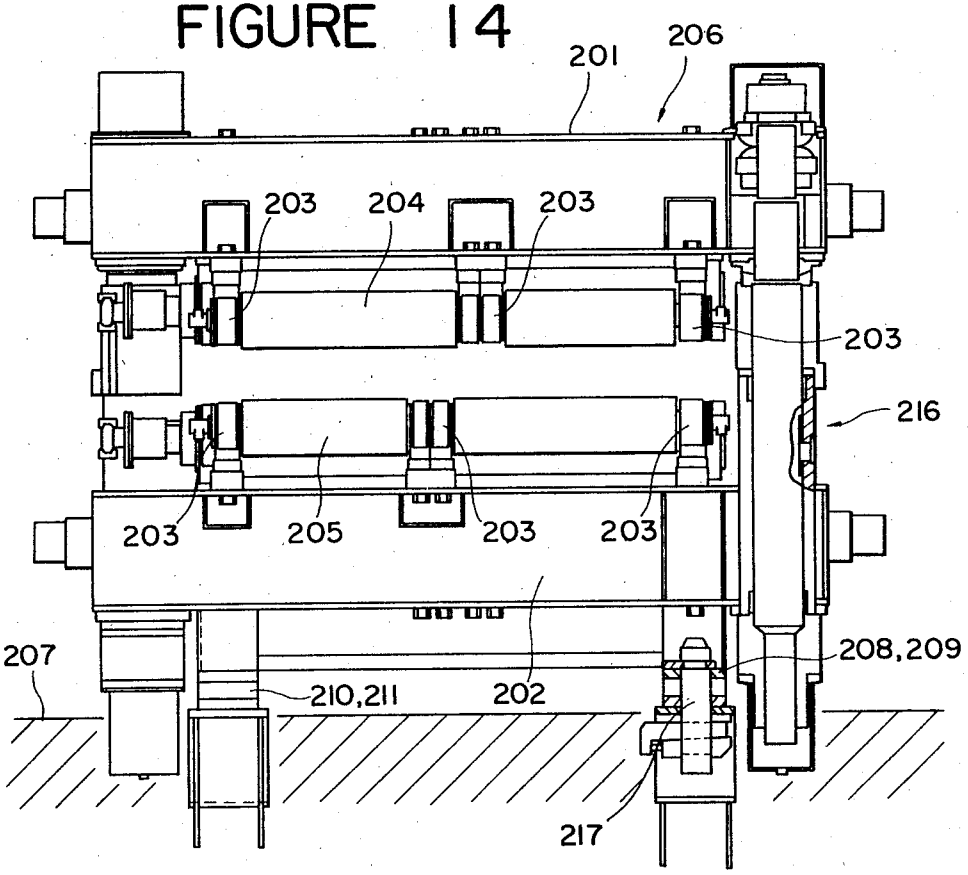
FIG. 14 is a schematic front view of the roll section of FIG. 13.

As shown in FIGS. 11 and 12, the rolls 125 and 126 are each formed with a cooling water passage 127 and have rotary joints 128 attached to the opposite ends thereof. Each rotary joint 128 is provided with a cooling water feed pipe 130 having a threaded end 129 which can be detachably threaded from the outside into a female screw 131 at the entrance of a roll cooling water passage 122 of a manifold block.

Sleeves 134 are fitted in and projected out of cooling water inlets 132 and outlets 133 which are formed at the bottom of the respective bearing boxes 113 to 116. The manifold blocks 117 to 120 are each provided with a socket 135 in communication with the bearing box cooling passage 123 and a socket 136 in communication with the bearing box communicating passage 124. The sleeves 134 at the bottom of the bearing boxes 113 to 116 can be disconnectibly connected to the sockets 135 and 136 by inserting the former in the seals 135 of the latter. Further, roll alignment becomes possible by providing shims between the bearing boxes 113 to 116 and manifold blocks 117 to 120.

On the other hand, located at the right end of the lower frame 112 are a roll cooling water feed pipe 138, a bearing box cooling water feed pipe 139 and a frame cooling water feed pipe 140 which extend out of the lower frame 112, connecting the pipes 138 and 139 to the roll cooling water passage 122 and bearing box cooling water passage 123 of the right manifold block 120 on the side away from the roll 126.

Similarly, located at the left end of the lower frame 112 are a roll cooling water discharge pipe 141, a bearing box cooling water discharge pipe 142 and a frame cooling water discharge pipe 143 which are extended out of the lower frame 112, connecting the pipes 141 and 142 to the roll cooling water passage 122 and bearing water cooling water passage 123 of the left manifold block 119, respectively. The bearing box communicating passages 124 of the left and right manifold blocks 119 and 120 are connected with each other in the lower frame 112 by an intercommunicating pipe 144.

Likewise, a roll cooling water feed pipe 138', a bearing box cooling water feed pipe 139' and a frame cooling water feed pipe 140' which are located at the right end of the upper frame 111 as well as a roll cooling water discharge pipe 141', a bearing box cooling water discharge pipe 142' and a frame cooling water discharge pipe 143' which are located at the left end of the upper frame 111 are extended out of the upper frame 111 and connected in a similar manner. The bearing box communicating passages 124 of the left and right manifold blocks 117 and 118 are connected with each other in the upper frame 111 by an interconnecting pipe 144'.

In this case, the cooling water which is fed through the respective feed pipes and water inlets 138 to 140 and 138' and 140' is circulated, on the part of the lower frame 112, for example, from the roll cooling water feed pipe 138 to the roll cooling water passage 123 of the right manifold block 120 and from one connecting pipe 30 to the other connecting pipe 30 through the axial cooling water passage of the roll 126, and then to the roll cooling water passage 123 of the left manifold block 119, and discharged out of the frame through the roll water discharge pipe 141.

The cooling water which is fed through the bearing box cooling water feed pipe 139 is circulated to the bearing box cooling water passage 123 of the right manifold block 120 and then circulated through the bearing box 116 from its water inlet 132 to water outlet 133, and thereafter sent to the bearing box cooling water passage 123 of the right manifold block 119 through the interconnecting pipe 144 and circulated through the bearing box 115 from its water inlet 132 to water outlet 133. The cooling water from the water inlet 133 is passed through the bearing box cooling water passage 123 and discharged out of the frame through the bearing box water discharge pipe 142.

Further, the cooling water from the frame water inlet 140 is conducted through the lower frame and discharged out of the frame through the frame water outlet 143. The cooling water is circulated through the upper frame 111 in a similar manner.

In this embodiment, the piping in the upper and lower frames 111 and 112 involve only the pipes 138 to 142 to the respective manifold blocks 117 to 120, so that the piping work can also be simplified to a significant degree. Besides, the bearing boxes 113 to 116 can be connected to the respective manifold blocks 117 120 simply by inserting the joint pipes in the sockets 135 and 136. The connecting pipes 30 of the rolls 125 and 126 can also be connected easily by threading them into the female screws 131 of the manifold blocks 117 to 120.

Shown in FIGS. 13 to 17 is a further embodiment of the invention, applying the above-described manifold blocks to piping of a base frame of a roll section in continuous slab casting facilities. In the particular embodiment shown in FIGS. 13 and 14, the roll section 206 has five sets of juxtaposed upper rolls 204 and five sets of juxtaposed lower rolls 205 opposingly mounted on upper and lower frames 201 and 202, respectively, through bearing boxes 203 which rotatably support the opposite ends of the respective rolls. The lower frame 202 is mounted on a base frame 207 through two pairs of front and rear manifold blocks 208 to 211 which are detachably secured to the base frame 207 by bolts 212.

Figure 15:
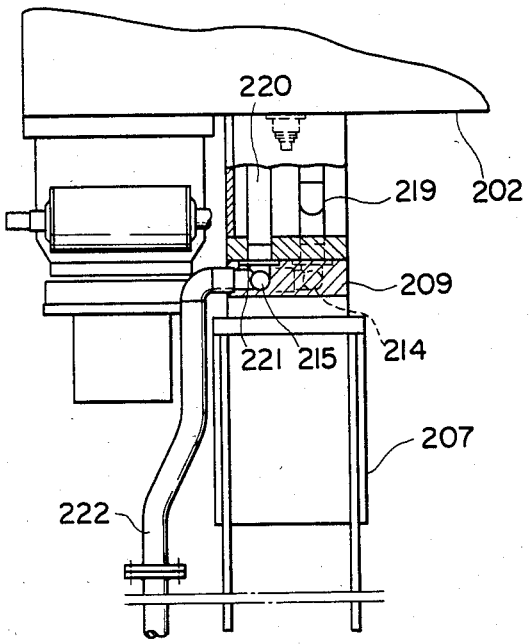
FIG. 15 is a partial sectional fragmentary view of the same piping assembly.
Figure 16:
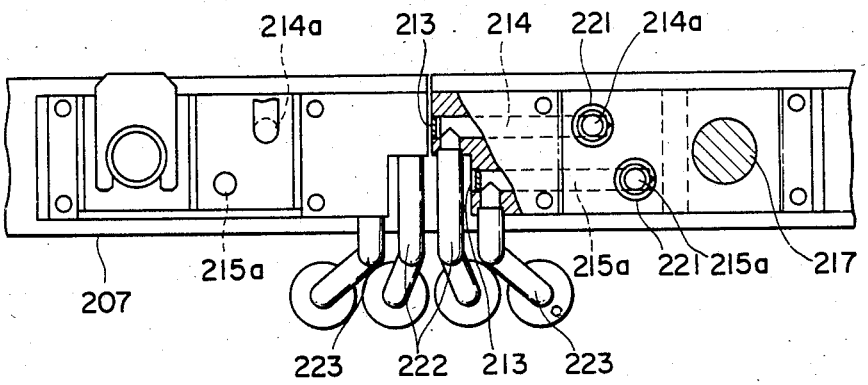
FIG. 16 is a partial sectional side view of the piping assembly shown in FIG. 15.
Figure 17:
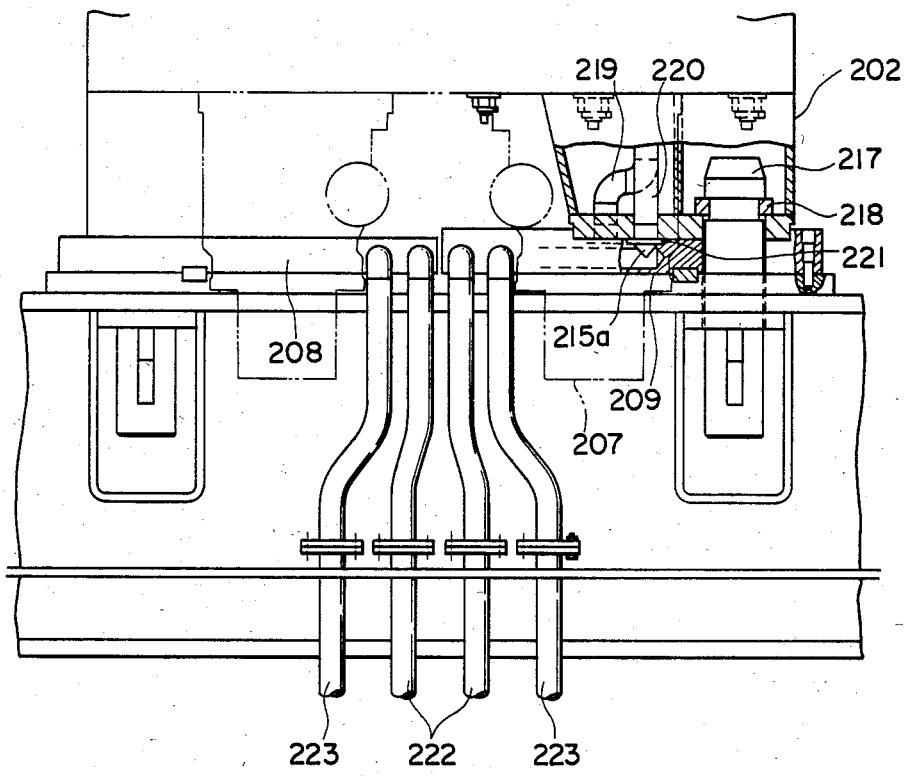
FIG. 17 is a partial sectional side view of the piping assembly of FIG. 15.

As shown particularly in FIGS. 15 to 17, each one of the manifold blocks 208 to 211 are provided with a pair of bored holes extending in the axial direction of the rolls and having the bored openings thereof closed by plug members 213, to provide, for example, a roll cooling water passage 214 and a bearing box cooling water passage 215 for the upper frame 201 in each one of the front manifold blocks 208 and 210 and a roll cooling water passage 214 and a bearing box cooling water passage 215 for the lower frame 202 in each one of the rear manifold blocks 209 and 211.

The manifold blocks 208 to 211 which are preformed with the passages 214 and 215 are fixed on the base frame 207 by bolts 212. If desired, the manifold blocks 208 to 211 may be integrally welded to the base frame 207. The lower frame 202 of the roll section 206 is mounted on these manifold blocks 208 to 211, and the upper frame 201 is supported on the lower frame 202 through a link mechanism 216 which maintains the upper frame 201 a predetermined distance from the lower frame 202.

The base frame 207 is provided with cotter pins 217 which are projected upward through the manifold blocks 208 to 211 and through cotter holes 218 in the lower frame 202, and stopped in position by washers 218, thereby detachably holding the lower frame 207 in a predetermined position on the base frame 207.

Formed on the frame mounting surfaces of the manifold blocks 208 to 211 are openings 214*a* and 215*a* which communicate with the passages 214 and 215, respectively. On the other hand, opened on the lower mounting surface of the lower frame 202 are the ends of pipes 219 and 220 which communicate with the upper and lower rolls 204 and 205 and the bearing box 203 and which are aligned and connected in a liquid tight manner with the openings 214*a* and 215*a* when the lower frame 202 is located in position on the base frame 207 by the cotter pins 217 and cotter holes 218. Reference numeral 221 indicates seals provided in the openings 214*a* and 215*a*.

Roll cooling water pipes 222 and bearing box cooling water pipes 223 are connected to one side of the left manifold blocks 208 and 209 in communication with the passages 214 and 215 in the respective blocks. Similarly, roll water discharge pipes and bearing box water discharge pipes are connected to one side of the right manifold blocks 210 and 211 in communication with the pasages 214 and 215 of the respective manifold blocks (not shown).

In this embodiment, the cooling water which is supplied through water pipes 222 and 223 to the left front manifold block 208 is led through the passages 214 and 215 of the manifold block 208 to the pipes 219 and 229 extending toward the upper frame 201. The cooling water from the pipe 219 is circulated through the roll 204, and then sent through the pipe 219 of the right front manifold block 210 and the passage 214 in the right front manifold block 210 and discharged to the outside through a discharge pipe. On the other hand, the cooling water from the pipe 220 is circulated through the left bearing box 203 and circulating pipe to the right bearing box 203, and then sent through the pipe 220 to the right front manifold block 210 and the passage 215 in the right front manifold block 20 and discharged to the outside through a discharge pipe.

Similarly, the cooling water which is fed through the water feed pipes 222 and 223 to the left rear manifold block 209 is circulated through the passages 214 and 215 of the manifold block 209 to the pipes 219 and 220 extending to the lower frame 202. The cooling water from pipe 219 is passed through the roll 205 and then through the pipe 219 to the right rear manifold block 211 to the passage 214 in the right rear manifold block 211 and discharged to the outside through a discharge pipe. On the other hand, the cooling water from the pipe 220 is passed through the left bearing box 203 and then through the interconnecting pipe for circulation through the right bearing box 203, and passed through the pipe 220 to the right rear manifold block 210 and the passage 215 of the right rear manifold block 210 and discharged outside through a discharge pipe.

Thus, it is just the connection of the water feed pipes 222 and 223 to the manifold blocks 208 to 211 on the base frame 207 that is required to be replaced at the time of re-assembling of the roll section, and there is no necessity for providing pipings in the base frame 207, so that the pipe re-arranging work can be simplified to a considerable degree. The cooling water is circulated to the rolls 204 and 205 and bearing boxes 203 of the upper and lower frames 201 and 202 from the water feed pipes 222 and 223 of the manifold blocks 208 and 210 on the base frame 207, and the user water from the rolls 204 and 205 and bearing boxes 203 is discharged to the outside through the discharge pipes of the manifold blocks 209 and 211.

Although the bores in the manifold blocks in the foregoing embodiments are used only for circulation of cooling water to and from the rolls and bearing boxes, the manifold blocks may further contain passages for frame cooling water, cast strip cooling water, compressed air, oil and the like if necessary.

The present invention has been described and illustrated by way of preferred embodiment, but it to be understood that the invention is not limited to the particular forms shown and various modifications and alterations can be added thereto within the scope of the invention as defined in the appended claims.

What is claimed is:

1. A piping assembly for cooling a roller section in a secondary cooling zone of a continuous casting line, comprising:

a support frame having a plurality of pairs of partition walls formed therein, a cooling inlet and outlet, and a cooling fluid passageway;

a plurality of pairs of bearing boxes mounted on said frame, wherein each of said bearing boxes includes a base portion having a fluid passage in direct communication with said cooling fluid passageway of said frame and wherein each of said bearing boxes includes a shaft hole;

a roller mounted on each of said pairs of bearing boxes and having an axial passageway formed therein for communicating with said fluid passages of said pairs of bearing boxes; and first and second circulating pipes located on opposite ends of said roller and each having one end secured to an outer wall of said bearing boxes and in communication with said fluid passage and a second end centrally positioned in said shaft hole of said bearing boxes for communicating with the axial passageway of said roller.

2. A piping assembly as set forth in claim 1, wherein said plurality of bearing boxes further comprises a first and second pair of bearing boxes located at opposed positions on said frame.

3. A piping assembly as set forth in claim 1, wherein said plurality of bearing boxes further comprise a first and second pair of bearing boxes located at opposed positions on said frame and a third and fourth pair of bearing boxes located at opposed positions on said frame for simultaneously guiding four sides of a cast strip passing therebetween.

4. A piping assembly as set forth in claim 1, further comprising means for dividing said frame into a feed water head portion in communication with said first circulating pipe and a discharge water header portion in communication with said second circulating pipe.

5. A piping assembly as set forth in claim 1, further comprising a joint pipe connecting said frame with each of said pairs of bearing boxes.

6. A piping assembly as set forth in claim 1, wherein said circulating pipe further comprises a U-shaped pipe.

7. A piping assembly as set forth in claim 1, wherein each of said bearing boxes includes a cooling passage and further comprising a manifold block connected to said frame and upon which each of said pair of bearing boxes are mounted, said manifold block including at least a fluid coolant inlet and outlet socket in communication with said cooling passage of said bearing boxes for cooling said bearing boxes.

8. A piping assembly as set forth in claim 7, wherein said circulating pipe further comprises a rotary joint member detachably connected to said manifold block.

* * * * *